US006219007B1

(12) United States Patent
Kline et al.

(10) Patent No.: US 6,219,007 B1
(45) Date of Patent: Apr. 17, 2001

(54) ANTENNA ASSEMBLY

(75) Inventors: Richard Scott Kline, Mechanicsburg; Stephen Daniel Gherardini, Harrisburg, both of PA (US)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/378,859

(22) Filed: Aug. 23, 1999

(51) Int. Cl.[7] ..... H01Q 1/36

(52) U.S. Cl. ..... 343/895; 343/702; 343/905; 343/906

(58) Field of Search ..... 343/702, 895, 343/905, 906

(56) References Cited

U.S. PATENT DOCUMENTS

| | | | | |
|---|---|---|---|---|
| 4,170,777 | * | 10/1979 | Liautaud | 343/715 |
| 4,882,591 | * | 11/1989 | Galvin et al. | 343/715 |
| 5,015,194 | * | 5/1991 | Seas | 439/314 |
| 5,229,784 | * | 7/1993 | Jones | 343/888 |
| 5,502,452 | * | 3/1996 | Gomez | 343/715 |
| 5,604,972 | | 2/1997 | McCarrick | 29/600 |
| 5,606,327 | | 2/1997 | Eillott et al. | 343/702 |
| 5,686,927 | | 11/1997 | Simmons | 343/702 |
| 5,717,409 | | 2/1998 | Garner et al. | 343/702 |
| 5,812,097 | | 9/1998 | Maldonado | 343/790 |
| 5,856,806 | | 5/1999 | Koleda | 343/702 |
| 5,880,696 | | 3/1999 | Koleda | 343/702 |
| 5,905,475 | * | 5/1999 | Annamaa | 343/895 |
| 5,990,848 | * | 11/1999 | Annamaa et al. | 343/895 |

FOREIGN PATENT DOCUMENTS

| | | | |
|---|---|---|---|
| 0 825 672 A2 | 2/1998 | (EP) | H01Q/5/00 |

* cited by examiner

*Primary Examiner*—Tan Ho
*Assistant Examiner*—Ephrem Alemu

(57) ABSTRACT

An antenna assembly (1) for connection to a wireless communications device (27) for adjusting the signals of amplifiers and line extenders of a broadband communications cable, has, an antenna coil (3) connected in one end of a conducting sleeve (4), a length of coaxial cable (5) having a central conductor (14) connected in another end of the sleeve (4), the sleeve (4) having a force fit connection in an axial bore (16) through a nonconducting housing (6), the coil (3) projecting outward of the housing (6) and being enclosed by an insulating hollow radome (2) that is mounted to the housing (6), and the housing (6) being adapted for connection to an exterior panel (26) of a portable, wireless communications device (27) for adjusting signals of amplifiers and line extenders of a broadband communication cable.

6 Claims, 3 Drawing Sheets

ANTENNA ASSEMBLY

FIELD OF THE INVENTION

The invention relates to an antenna assembly for transmitting rf, radio frequency, signals.

BACKGROUND OF THE INVENTION

Broadband rf services, in the form of audio signals, video signals and Internet access communications signals, for example, are distributed over broadband communications cables to numerous subscribers of such services. Electronic devices, in the form of signal amplifiers and cable line extenders, are distributed along the transmission cables to amplify the signals, and to maintain a balanced load. Typically, the transmission cables are elevated above ground by poles, with the devices being at the poles, and being mounted on the transmission cables or hanging parallel to the cables. The signals of these amplifiers and extenders are in need of periodic adjustment, for example, to transmit the signals over longer distances, to supply the signals to an increased number of subscribers, and to maintain a balanced load distribution of the signals among multiple subscribers. In the past, these devices needed direct physical contact with them to have their signals adjusted, which required a person to be lifted to each device on a pole, that person to make the adjustment while being elevated above ground, and that person to be lowered and transported to a device at another location, where the process was repeated. The process of lifting, adjusting and lowering, involved expensive lifting equipment and a concern to ensure personal safety. The time required to conduct the process was lengthy.

With advances in wireless communications technology being applied to improve the amplifier and extender devices, they are now provided with known transceivers and are adjustable by communicating with a portable, wireless communications device. Such a wireless communications device has known electronic transceivers that communicate remotely with the amplifiers and line extenders, and eliminates the need for direct physical contact with them. The risk of personal safety is reduced substantially, and further, the time required to conduct the process is substantially reduced. A portable, wireless communications device, for adjusting amplifiers and line extenders of a broadband transmission cable, requires an antenna assembly that is properly tuned to a frequency band of the communications signal being transmitted between the wireless communications device and the amplifiers and line extenders. The antenna assembly must be light in weight, and sealed from the elements of weather.

SUMMARY OF THE INVENTION

The invention resides in an antenna assembly that is tuned to a frequency band of a signal of a wireless communications device for adjusting the signals of amplifiers and line extenders of a broadband communications cable. The invention resides further in an antenna assembly that is sealed from the elements of weather.

According to the invention, an antenna assembly that is tuned to a frequency band of a signal of a wireless communications device for adjusting the signals of amplifiers and line extenders of a broadband communications cable, has; a helical antenna coil connected in one end of a conducting sleeve, a length of coaxial cable has a central conductor connected in another end of the sleeve, the cable having a dielectric concentrically surrounding the central conductor, the cable having an outer conducting shield concentrically surrounding the dielectric, the sleeve having a force fit connection in an axial bore through a nonconducting housing, the coil projecting outward of the housing and being enclosed by an insulating hollow radome that is mounted to the housing, the housing being adapted for connection to an exterior panel of a portable, wireless communications device for adjusting signals of amplifiers and line extenders of a broadband communication cable, wherein, a threaded shaft on the housing projects from a panel facing surface of the housing, the threaded shaft receives a threaded nut thereon, a seal surrounds the shaft and is received against the panel facing surface to form a seal therewith, and the cable projects from the bore through the housing for connection of the antenna assembly to a location behind the exterior panel of the portable, communications device for adjusting the signals of the amplifiers and line extenders.

Further, according to the invention, a sealing material surrounds the sleeve where the sleeve is force fit with the bore through the housing to form a seal with the sleeve and the housing.

Further, according to another aspect of the invention, the radome surrounds the housing with a resilient snap fit on the housing to form a seal therewith.

DESCRIPTION OF THE DRAWINGS

An embodiment of the invention will now be described with reference to the accompanying drawings, according to which.

DETAILED DESCRIPTION

Figure 1:
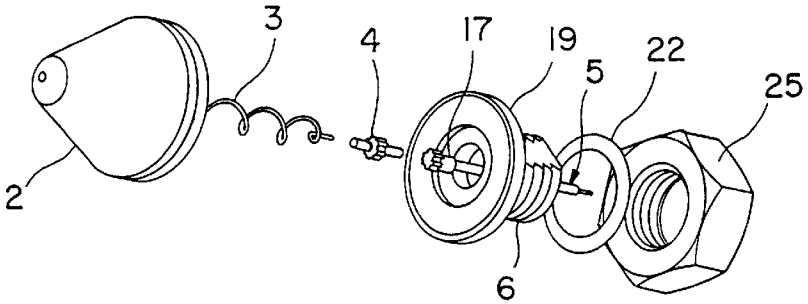
FIG. 1 is an isometric view of an antenna assembly, with component parts being shown as separated from one another.
Figure 3:
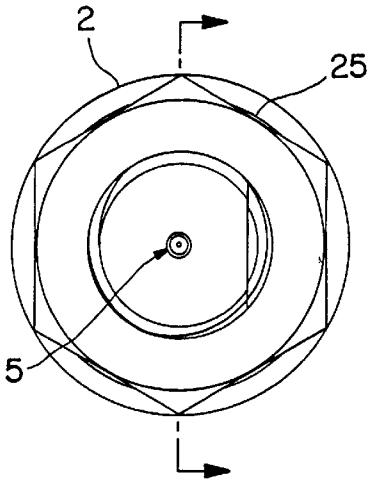
FIG. 3 is an end view of the antenna assembly as shown in FIG. 2.

With more particular reference to FIGS. 1–3, an antenna assembly 1 will now be described. The antenna assembly 1 comprises a hollow radome 2 enclosing a monopole antenna coil 3 that is connected in one end of a conducting sleeve 4. A length of a coaxial cable 5 is connected in another end of the sleeve 4. In turn, the sleeve 4 is connected with a friction fit along the axis of a housing 6.

With reference to FIGS. 4–7, the antenna coil 3 will now be described. The antenna coil 3 is a continuous, round wire of a conducting material, for example, phosphor-bronze, coiled into a helix having a pitch, diameter and overall length, which are complementary to the waveform of an rf signal being transmitted and received by a device, such as, a wireless communications device for adjusting the signals of amplifiers and line extenders of a broadband communications cable.

With continued reference to FIGS. 4–7, the antenna coil 3 has an axial length that is a multiple of the wavelength of an rf signal being transmitted and received by a device, such as, a wireless communications device for adjusting the signals of amplifiers and line extenders of a broadband communications cable. An end of the coil 3 has a cylindrical coil section 7 of a fractional wavelength in length, continuous with a radial section 8 of the coil 3, in turn, that is unitary with an axially extending stub end 9.

Figure 9:
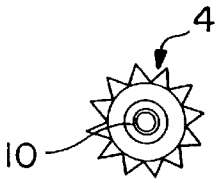
FIG. 9 is an end view of the sleeve, as shown in FIG. 8.
Figure 8:
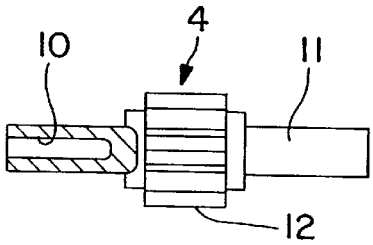
FIG. 8 is a side view, partially shown in section, of a sleeve.
Figure 10:
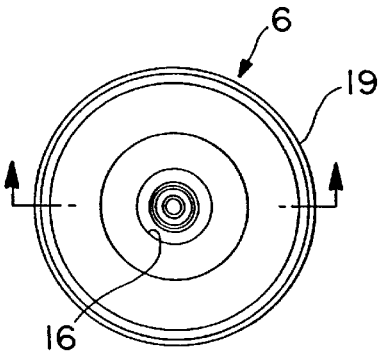
FIG. 10 is a top view of a housing.

With reference to FIGS. 8 and 9, the sleeve 4 will now be described, as being of unitary construction from a conducting material, for example, brass. The sleeve 4 has hollow ends 10, 11 that are of similar construction, the hollow end 10 being shown in section in FIG. 8, and an enlarged cylindrical, middle section 12 that is provided with a roughened exterior circumference, for example, knurling being shown. The stub end 9 of the coil 3 and the hollow end 10 of the sleeve 4 are connected, for example, by a solder joint or crimped compression joint, FIG. 2, providing an electrical connection.

Figure 2:
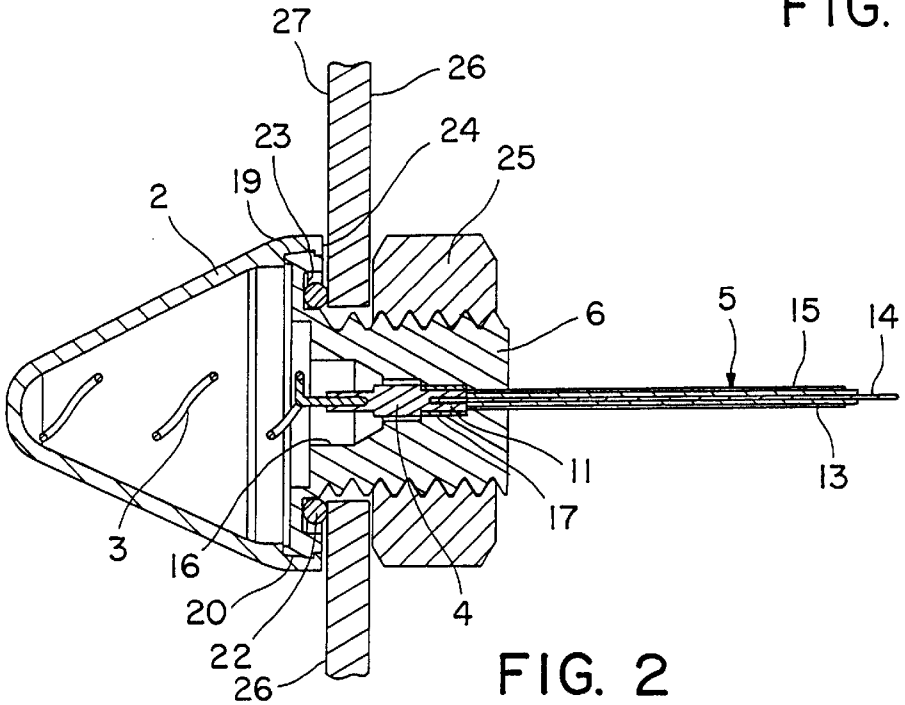
FIG. 2 is cross section view of the antenna assembly as shown in FIG. 1.
Figure 4:
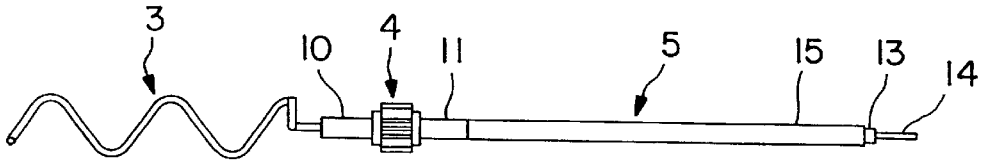
FIG. 4 is a side view of an antenna coil and sleeve.
Figure 5:
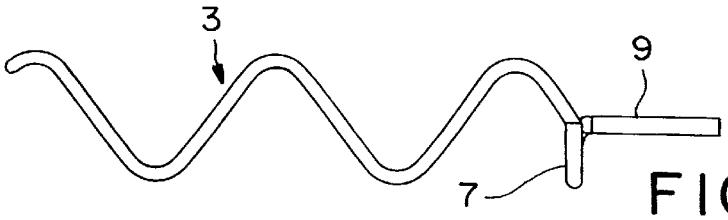
FIG. 5 is a top view of the antenna coil that is shown in FIG. 4.
Figure 6:
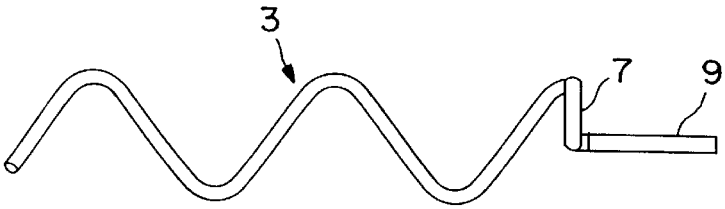
FIG. 6 is a side view of the antenna coil, as shown in FIG. 5.
Figure 7:
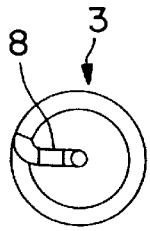
FIG. 7 is an end view of the antenna coil, as shown in FIG. 6.

With further reference to FIG. 2, the length of coaxial cable 5 has a dielectric 13 concentrically surrounding a central conductor 14, the cable 5 having an outer conducting shield 15 concentrically surrounding the dielectric 13. the hollow end 11 of the sleeve 4 and the central conductor 14 in the hollow end 11 of the sleeve 4 are connected, as shown in FIGS. 2 and 4, for example, by a solder joint or crimped compression joint, providing an electrical connection.

Figure 12:
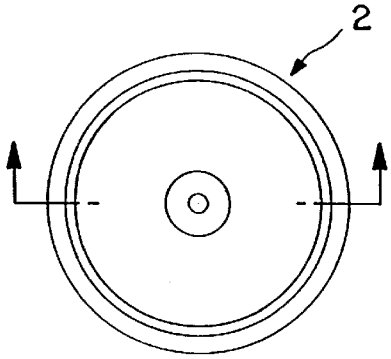
FIG. 12 is a top view of a radome.
Figure 13:
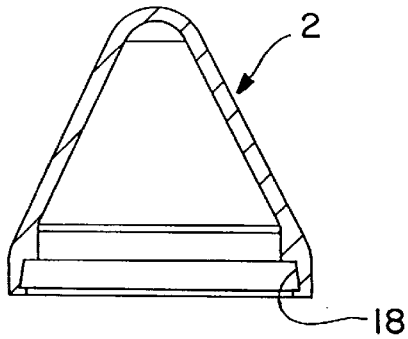
FIG. 13 is a side view in section of the radome that is shown in FIG. 12.

With reference to FIG. 2, following connection of the sleeve 4 with the antenna coil 3 and with the length of coaxial cable 5, the sleeve 4 is inserted along a stepped axial bore 16 through the housing 6 that is fabricated, for example, by molding a nonconducting material, for example, Noryl plastics material. A bushing of sealant material 17 is assembled to encircle the conducting sleeve 4 that is, thereafter, pressed into and along the bore 16 to provide a fiction fit in the bore 16 through the housing 6. The sealant material 17 provides an environmental seal with the housing 6 and the sleeve 4. The antenna coil 3 projects from an exterior facing end of the housing 6. The hollow radome 2, FIGS. 12 and 13, is fabricated by molding an nonconductive material, for example, Noryl plastics material. The radome 2 has a smoothly tapered exterior and a stepped open end 18 providing a resilient, snap fit connection over and onto a complementary shaped, stepped, protruding lip 19, FIG. 2, on the exterior of the housing 6, at the exterior facing end. A slender environmental seal 20 is provided by the snap fit connection. The addition of a sealant at the snap fit connection is an optional enhancement of the environmental seal 20.

Figure 11:
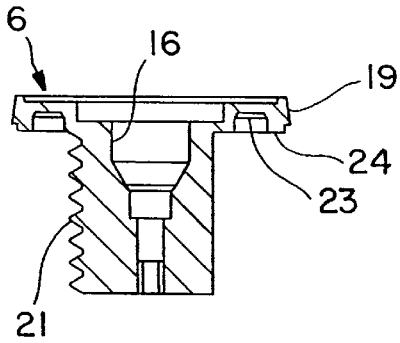
FIG. 11 is a side view in section of the housing that is shown in FIG. 10.

The length of coaxial cable 5 projects from the bore 16 and from an interior facing end of a threaded shaft 21 on the housing 6, as shown in FIG. 11. A continuous seal 22, for example, provided by an O-ring, encircles the shaft 21, and registers in a groove 23 in a panel facing surface 24 from which the shaft 21 projects. As shown in FIG. 2, the threaded shaft 21 receives a threaded nut 25 thereon to comprise fasteners mounting the antenna assembly 1 to a panel 26. Other fasteners comprise, adhesives, rivets or bolts, secured to the housing 6.

The O-ring type seal 22 surrounds the shaft 21 and is received against the panel facing surface 24 to form a seal 22 therewith, as the nut 25 is driven and the nut 25 and panel facing surface 24 is tightened against an exterior panel 26 of a known, wireless communications device, shown generally at 27. The cable 5 projects from the bore 16 through the housing 6, and to a location behind the exterior panel 26, to connect with the known electronic transceiver of a portable, wireless communications device 27 for adjusting the signals of the amplifiers and line extenders.

The shield 15 of the length of coaxial cable 5 is, either, a semirigid shield 15 that allows the cable 5 to assume a rigid shape, shown as being straight in FIG. 2, or the cable 5 has a flexible shield 15 that allows the cable 5 to be limp and flexible, which construction allows for the cable 5 to be formed with a rigid shape, or to be flexibly shaped, to position the distal end of the cable 5 for ease of connection to suit the individual construction of the transceiver of the wireless communications device 27. The particular, individual construction of the wireless communications device 27 provides no part of the invention, and is easily connected to the invention, by connecting with the length of the coaxial cable 5 in a known manner, for example, by using a known commercially available electrical connector or by providing a solder joint or crimp connection joint with the coaxial cable 5.

Although a preferred embodiment of the invention has been described, other embodiments and modifications of the invention are intended to be covered by the spirit and scope of the claims:

What is claimed is:

1. An antenna assembly that is tuned to a frequency band of a signal of a wireless communications device for adjusting the signals of amplifiers and line extenders of a broadband communications cable, comprising:

a conducting sleeve having a hollow first end and a hollow second end, a helical antenna coil connected in one end of the conducting sleeve, a length of coaxial cable having a central conductor connected in the hollow second end of the sleeve and providing a second electrical connection, the cable having a dielectric concentrically surrounding the central conductor, the cable having an outer conducting shield concentrically surrounding the dielectric, a housing, an axial bore through the housing, the sleeve having a friction fit connection in the axial bore through the housing, the coil projecting from the sleeve and from the axial bore and outward of the housing, the coil being enclosed by a hollow radome that is mounted to the housing, the housing being adapted for connection to an exterior panel of a portable, wireless communications device for adjusting signals of amplifiers and line extenders of a broadband communication cable, wherein, a threaded shaft on the housing projects from a panel facing surface of the housing, the axial bore extends through the threaded shaft, the threaded shaft receives a threaded nut thereon, a seal surrounds the threaded shaft and is received against the panel facing surface to form a seal therewith, and the cable projects from the sleeve and from the axial bore and from the threaded shaft for connection of the antenna assembly to a location behind the exterior panel of the portable, communications device for adjusting the signals of the amplifiers and line extenders.

2. An antenna assembly as recited in claim 1 and further comprising: a sealing material within the axial bore and surrounding the sleeve where the sleeve is friction fit with the axial bore to form a seal with the sleeve and the housing.

3. An antenna assembly as recited in claim 1, and further comprising: the radome surrounds the housing with a resilient snap fit around the panel facing surface of the housing to form a seal therewith.

4. An antenna assembly as recited in claim 1, and further comprising: the cable is a semi-rigid coaxial cable.

5. An antenna assembly as recited in claim 1, and further comprising: the cable has a flexible shield.

6. An antenna assembly as recited in claim 1, and further comprising: the housing is fabricated of a nonconducting material.

* * * * *